US006283768B1

(12) United States Patent
Van Naarden

(10) Patent No.: US 6,283,768 B1
(45) Date of Patent: Sep. 4, 2001

(54) RJ-45 STYLE MODULAR CONNECTOR

(75) Inventor: Robert W. Van Naarden, Hinckley, IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 09/311,015

(22) Filed: May 13, 1999

(51) Int. Cl.[7] ..... H01R 12/00
(52) U.S. Cl. ..... 439/76.1; 439/676
(58) Field of Search ..... 439/76.1, 676, 439/344, 404, 405, 460

(56) References Cited

U.S. PATENT DOCUMENTS

| | | | | |
|---|---|---|---|---|
| 4,431,246 | | 2/1984 | Vaden | 439/404 |
| 4,969,839 | * | 11/1990 | Nilsson | 439/395 |
| 5,125,852 | | 6/1992 | Archer | 439/555 |
| 5,145,401 | | 9/1992 | Archer | 439/395 |
| 5,199,891 | | 4/1993 | Reed | 439/98 |
| 5,299,956 | | 4/1994 | Brownell et al. | 439/638 |
| 5,310,363 | | 5/1994 | Brownell et al. | 439/676 |
| 5,492,484 | | 2/1996 | Archer | 439/395 |
| 5,496,191 | | 3/1996 | Johnston | 439/404 |
| 5,593,314 | | 1/1997 | Lincoln | 439/418 |
| 5,647,763 | | 7/1997 | Arnold et al. | 439/540.1 |
| 5,674,093 | | 10/1997 | Vaden | 439/676 |
| 5,899,770 | * | 5/1999 | Ezawa | 439/676 X |
| 5,961,354 | * | 10/1999 | Hashim | 439/676 |
| 5,967,801 | * | 10/1999 | Martin et al. | 439/76.1 |
| 5,975,936 | * | 11/1999 | Lin et al. | 439/676 X |
| 6,042,427 | * | 3/2000 | Adriaenssens et al. | 439/676 |
| 6,080,007 | * | 6/2000 | Dupuis et al. | 439/676 X |

* cited by examiner

*Primary Examiner*—Brian Sircus
*Assistant Examiner*—Son V. Nguyen
(74) *Attorney, Agent, or Firm*—Cook, Alex, McFarron, Manzo, Cummings & Mehler, Ltd.

(57) ABSTRACT

An RJ-45 style modular connector for use with twisted pair cable has a hollow shell with an internal printed circuit board having insulation displacement pins arranged to receive individual wires of the cable. Traces on the printed circuit board extend from the pins to edge connectors. A wire mounting block fits into the shell and holds the wires for engagement with the insulation displacement pins.

2 Claims, 5 Drawing Sheets

Fig. 10.
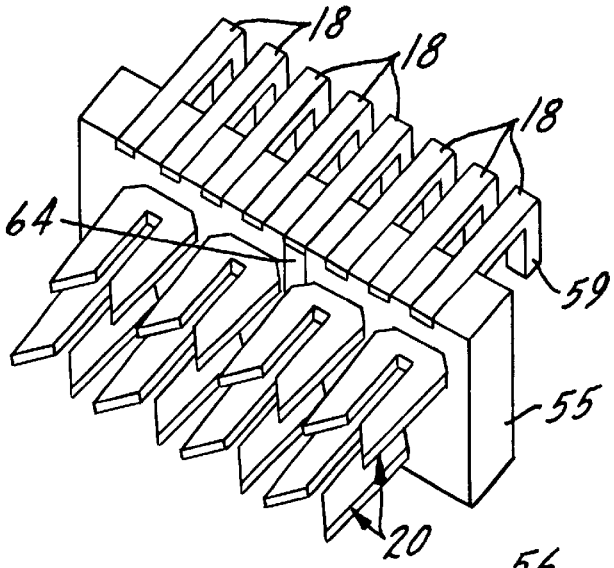
Fig. 11.
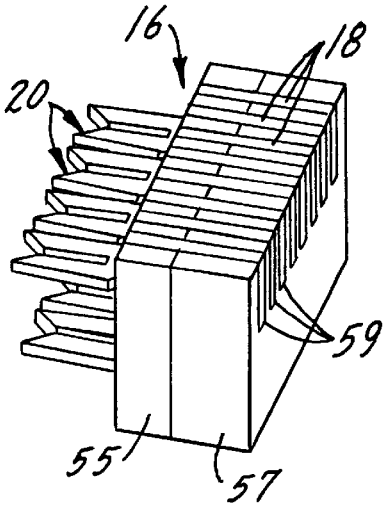
Fig. 12.
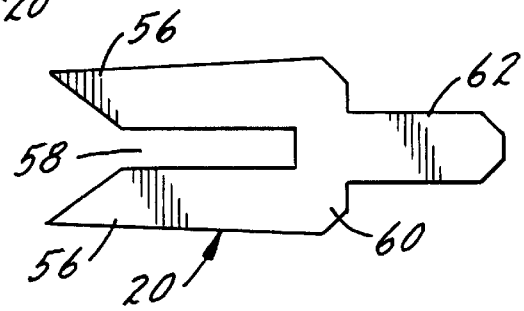
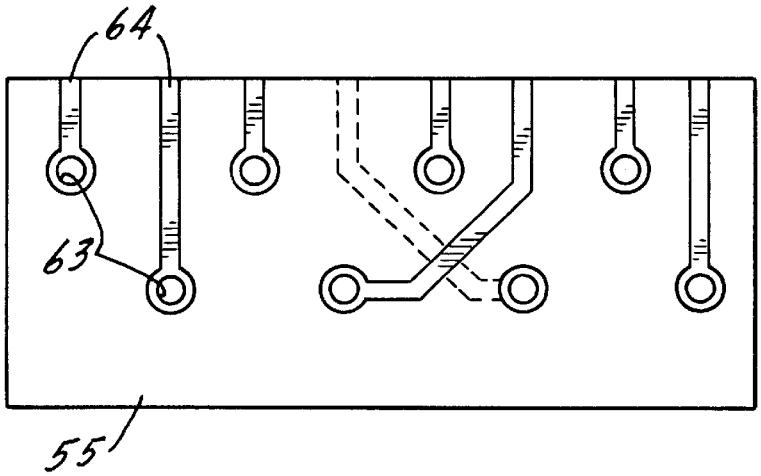
Fig. 13.

RJ-45 STYLE MODULAR CONNECTOR

BACKGROUND OF THE INVENTION

This invention relates to an RJ-45 style modular connector. These it, connectors have a female portion known as a jack or socket and a male portion called a plug. The present invention concerns an improved plug for an RJ-45 connector. The jack typically has a housing containing a planar array of parallel contacts which make sliding, electrically-conducting contact with the plug. The jack contacts often are metal blades having a cantilevered portion that is biased into engagement with the plug in the nature of a leaf spring. For this reason the jack contacts are referred to herein as spring contacts.

RJ-45 connectors were originally developed to terminate flat telephone cable and are very well suited to that application. In recent years these connectors have also been used for data communications purposes including terminations of unshielded twisted pair (UTP) cable for high speed data transmission. The latter application has been divided into data transmission speeds called categories with category 5 being data transmission up to 150 megabits per second. At this data rate, the connector becomes an integral part of data transmission wiring and has a large effect on the maximum rate of data transmission. This invention relates to a connector plug that is capable of terminating UTP cable in a category 5 data transmission network.

A UTP cable comprises at least two individual, insulated wires. A wire, as used herein, will refer to the combination of a conductor and a surrounding insulation layer. Two such wires, known as a pair, are twisted together. For most data communications applications the UTP cable will have four pairs. The plurality of twisted pairs are gathered together within an outer insulation jacket. This imparts a configuration that is relatively round compared to flat cables. In other words, the gathered pairs of the UTP cable define a two-dimensional cross-section that will be referred to herein as a bundled cross-section. The bundled cross-section may include one or more inner wires in the interior of the bundle and a plurality of surrounding outer wires. The bundled cross-section contrasts with a linear configuration which, as used herein, is a group of wires, conductors or contacts laid side-by-side next to one another in a flat, planar array which defines essentially a one-dimensional cross-section (ignoring for this definitional purpose the thickness of each wire). That is, a linear configuration or array is one in which the centers of the individual wires, when viewed in cross-section, define a straight line.

Using a standard RJ-45 connector with UTP cable is difficult because the cable is bundled but the RJ-45 connector's contacts must terminate in a linear fashion. That is, when using an RJ-45 connector on UTP cable the two-dimensional, bundled cross-section of the UTP cable must be transposed to a one-dimensional configuration. In a sense the problem is one of fitting a round peg into a flat hole. The prior art solution to this problem is to untwist the wires, arrange them linearly in the correct order and insert the wires into the connector and crimp the connector onto the wires. But untwisting of the individual wires of the cable causes degradation of the data transmission capability. One reason for this is the linear array is subject to cross talk on the nested pairs at the center of the array. Further, the strain relief action of existing connectors tends to smash the individual conductors into an oval shape which further degrades their transmission capability.

SUMMARY OF THE INVENTION

The present invention allows for easy termination of UTP cable in an RJ-45 plug in a manner that reduces the amount of unbundling of the pairs and reduces cross talk. The plug has an outer shell enclosing a contact block, attachment elements in the forms of insulation displacement connector (IDC) pins and a wire mounting block. The contact block has a linear array of contacts on one edge which are arranged to mate with similar contacts in the RJ-45 jack into which the plug is inserted. The linear contacts are electrically connected to the IDC pins either by being integrally formed therewith in a plate or by means of a printed circuit (pc) board. The IDC pins are mounted to either the contact block or the pc board in a non-linear array. The wire mounting block has a body with openings through which wires are placed. Grooves in the front end face of the body receive the wires and present them for connection to the IDC pins. The wire mounting block will also employ a strain relief that will capture the cable's outer insulation jacket and contain the cable in a bundled cross-section.

The installer will strip off a length of the outer insulation jacket of the UTP cable exposing the individual wires of the twisted pairs. The pairs will be inserted into the wire mounting block and wrapped around the body, laying the wires into the grooves and troughs on the front and side faces of the mounting block. The UTP cable is untwisted only enough to allow the wires to separate and fit into the grooves. The outer insulation jacket will be inserted far enough that the strain relief will contact the outer insulation jacket, providing strain relief action when the wire mounting block is inserted into the shell. The terminating action will occur when the mounting block is pushed into the shell and the IDC pins penetrate the wire insulation, making contact with the individual wire conductors. In the pc board form there is a relief slot beneath each wire in the end of the wire mounting block to allow the IDC pins to slide past the wire into the body of the mounting block. The mounting block will then snap into the housing completing the connection. The strain relief may be provided by two half sleeves attached to the wire mounting block by living hinges. The sleeves will fold together and close on the cable after the cable has been inserted into the mounting block.

BRIEF DESCRIPTION OF THE DRAWINGS

FIG. 10 is a perspective view of the printed circuit board.

FIG. 11 is a perspective view of the printed circuit board and contact holder assembly.

FIG. 12 is a plan view of an attachment element, on an enlarged scale.

FIG. 13 is a front elevation view of the printed circuit board, showing a typical arrangement of conductive traces.

DETAILED DESCRIPTION OF THE INVENTION

Figure 1:
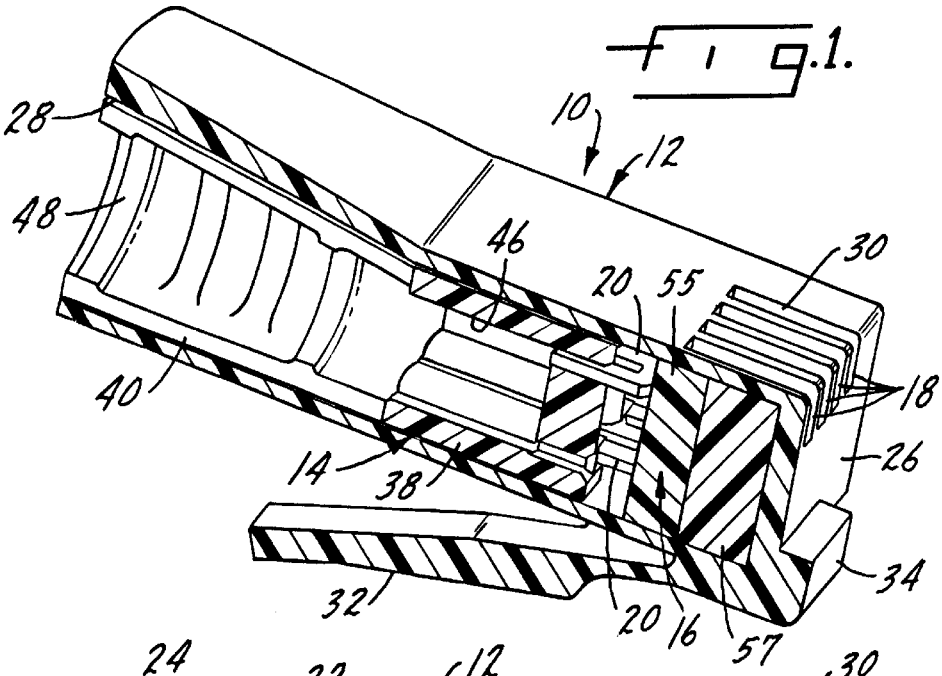
FIG. 1 is a perspective view, with a portion broken away, of an assembled connector plug according to one form of the present invention. For clarity no cable is shown in the plug.

FIG. 1 shows the RJ-45 style modular connector plug 10 of the present invention. The plug has a housing enclosing a printed circuit board. The housing comprises an outer shell 12 and a wire mounting block 14. The shell is generally a five-sided enclosure having an open end into which the wire mounting block 14 is inserted. At the closed end of the shell is a printed circuit board and contact holder assembly 16. The assembly 16 includes a plurality of elongated conductive contacts 18 formed on the top edge of the board in linear fashion. As can be seen, the contacts 18 are laid out parallel to one another and are spaced according to the standard RJ-45 spacing. The printed circuit board further includes a plurality of conductive attachment elements 20 disposed on one face of the board. In a preferred embodiment, the attachment elements comprise insulation displacement connector (IDC) pins having a slot defined by two tines. The tines are spaced so as to pierce the insulation of an individual wire of the UTP cable and engage the underlying conductor of the wire. The printed circuit board further includes a plurality of conductive traces, as shown and described below. Each trace electrically connects one of the attachment elements 20 to one of the conductive contacts 18.

Figure 2:
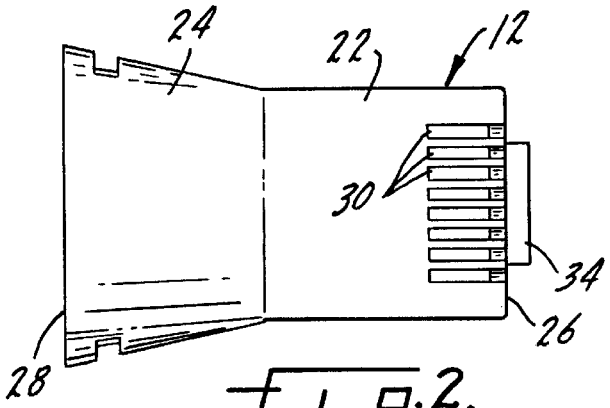
FIG. 2 is a top plan view of the outer shell of the connector.
Figure 3:
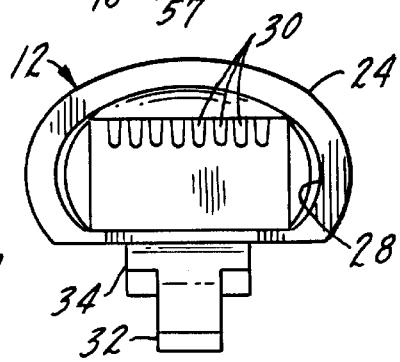
FIG. 3 is a rear end elevation view of the outer shell.
Figure 4:
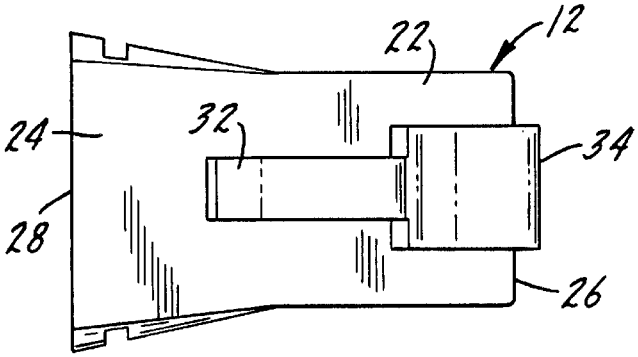
FIG. 4 is a bottom plan view of the shell.
Figure 5:
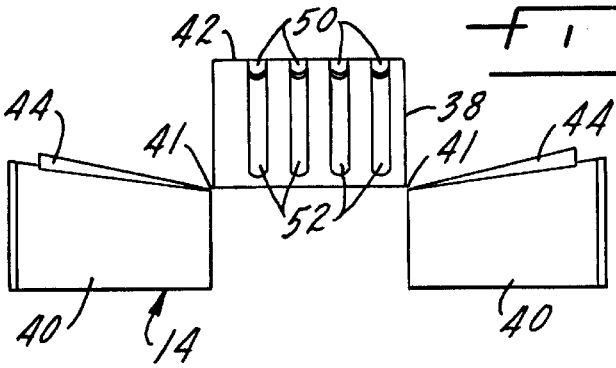
FIG. 5 is a top plan view of the wire mounting block.
Figure 7:
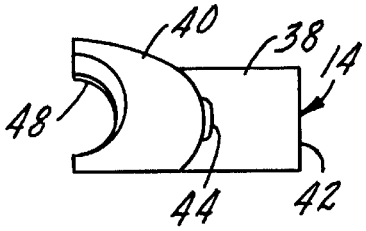
FIG. 7 is a side elevation view of the wire mounting block.

Details of the shell construction are shown in FIGS. 2–4. The shell includes a case 22 and a skirt 24. The case 22 has a generally rectangular cross-section and terminates at a closed end 26. Opposite the closed end the skirt 24 flares outwardly from the case. The skirt has a generally D-shaped cross-section as best seen in FIG. 3. The skirt defines an open end 28 which provides access to the hollow interior of the shell. For reference purposes the closed end 26 will be called the front end of the plug and the open end 28 is the rear end. On the inside wall of the skirt, just inside the open end 28, there is an annular notch. The notch receives a flange on the wire mounting block 14 to retain the wire mounting block in the shell.

The top wall of the case 22 includes a plurality of slots 30. The slots extend all the way through the wall thickness. They are arranged in the linear, parallel fashion shown. The slots are sized and spaced to align with and provide access to the electrical contacts 18 of the printed circuit board 16. On the underside of the shell is a release lever 32. The release lever 32 is cantilevered from an anchor 34 which curves around the corner of the case 22. The lever includes a latch which is releasably engageable with the jack into which the connector is inserted.

FIGS. 5–9 show details of the wire mounting block 14. The wire mounting block has a five-sided, hollow body 38 and a pair of sleeves 40 attached to the body at living hinges 41. The body terminates at a front end face 42. The sleeves 40 have flanges 44 on their outer surfaces. The two sleeves together define a D-shaped configuration that generally matches that of the open end 28 of the shell 12. Flanges 44 fit into the notch on the shell interior when the plug is assembled. A plurality of arcuate ribs 48 extend on the inner surfaces of the sleeves 40. The ribs can clamp down on the outer insulation jacket upon insertion of the wire mounting block 14 into the shell 12 to provide strain relief.

A central bore 46 (FIG. 6) extends through the body 38 up to the front face 42 for receiving the UTP cable therein. A plurality of openings 36 are formed in the front face. Each opening 36 is sized to permit passage of both wires of a pair through the opening. Thus, the wire pairs can remain twisted inside the bore 46 of body 38. The wire pairs are untwisted only outside the front end face 42. The portions of the pairs sticking out the front end face 42 are untwisted and placed in one of a plurality of means for supporting the individual wires of a UTP cable. In this embodiment, the supporting means comprises eight grooves or channels 50 formed in the end face 42. Each groove 50 merges with a trough 52 formed on the top and bottom of the body 38. Each groove is intersected by a relief slot 54 (see FIG. 9). The relief slots 54 are located so as to receive the tips of the insulation displacement connectors 20.

Further details of the printed circuit board and contact holder assembly 16 are shown in FIGS. 10–13. The printed circuit board 55 supports eight attachment elements 20 and eight elongated conductive contacts 18. The contacts 18 may be metal bands that are pressed into aligned notches or depressions formed in the top of both the pc board 55 and a contact holder block 57 (FIG. 11). A folded over corner 59 of the contacts helps hold the pc board 55 and contact holder block 57 together.

FIG. 12 shows the complete attachment element 20. Each attachment element 20 comprises a U-shaped blade or fork having a pair of tines 56 separated by a slot 58. The bail 60 of the attachment element merges into a leg 62. The leg 62 is embedded in a plated-through hole 63 (FIG. 13) in the circuit board 55. The leg 62 is force fit into the hole, making electrical connection with the plating therein. The plated-through holes 63 in the pc board 55 are connected to the contacts 18 by a series of conductive traces 64 such as seen in FIG. 13. One of the traces in this example is shown in dotted lines on the opposite side of the board. The traces 64 provide electrical connection between the conductive contacts 18 and the attachment elements 20 and in this sense can be considered bridge conductors. The 3–6 and 4–5 pairs in T568A & B are crossed on the printed circuit board at right angles using balanced transmission line traces.

Figure 6:
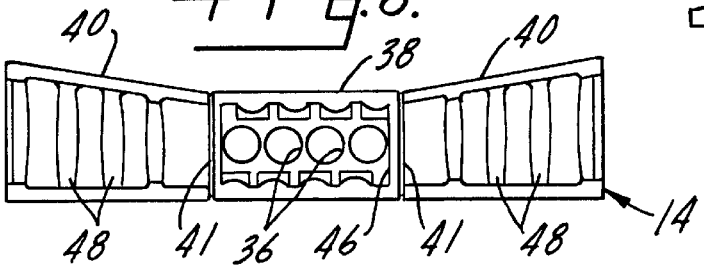
FIG. 6 is a rear end elevation view looking into the interior of the wire mounting block.
Figure 8:
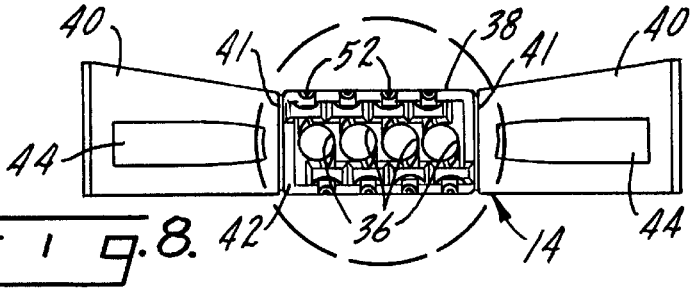
FIG. 8 is a front end elevation view of the wire mounting block.
Figure 9:
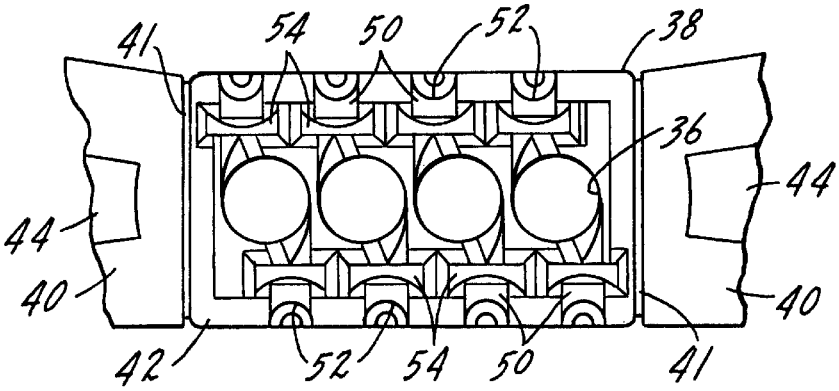
FIG. 9 is an enlarged detail view of the circled portion of FIG. 8.

The wire mounting block 14 is prepared by removing a short length of the outer insulation jacket from an end portion of a UTP cable. This exposes the twisted pairs beneath. The insulation from the individual wires need not be removed when insulation displacement connectors are used for the attachment elements. The exposed end of the UTP cable is inserted into the bore 46 of the wire mounting block 14. One twisted pair is passed through each opening 36 in the end face 42 of the wire mounting block. Using the T568A and 568B standard, the 7–8 wires would be placed in the left opening 36 as seen in FIG. 6. The 4–5 wires would be in the second from left opening, wires 3–6 in the second from right opening and wires 1–2 go in the right opening 36. Then the individual wires are placed into one of the grooves 50 and folded around the top or bottom of the wire mounting block into the troughs 52. The troughs 52 have a diameter such that a portion of the wire insulation will extend beyond the perimeter of the wire mounting block head 38. There is sufficient clearance between the wire mounting block 14 and the inner walls of the shell 12 to accommodate the wires in a press fit. This provides some strain relief on the cable.

With the wires laid out into the grooves and troughs, the sleeves 40 are folded about the hinges 41 thereby clamping onto the outer insulation jacket of the UTP cable to provide strain relief. Then the wire mounting block 14 is inserted into the open end 28 of the shell 12. When the end face 42 approaches the attachment elements 20 in printed circuit board 55, the slots 58 of the elements 20 will receive the wires and the tines 56 will cut through the insulation of the wires, forcing the tines into contact with the conductors of the individual wires. When the wire mounting block is pushed home, the tines 56 will reside in the relief slots 54 of the mounting block 14, trapping the wires in the grasp of the attachment elements. As mentioned above, the engagement of the notch and flange will retain the wire mounting block in the shell. The connector plug 10 is now ready for use.

Insertion of the completed connector into a jack brings the spring contacts of the jack into engagement with the contacts 18 through the shell slots 30. The traces 64 provide electrical connection between the contacts 18 and the legs 62 of the attachment elements 20, with the tines 56 completing the circuit to the conductors of the individual wires. The latch on lever 32 will engage the jack in the conventional manner to retain the plug in the jack.

Figure 14:
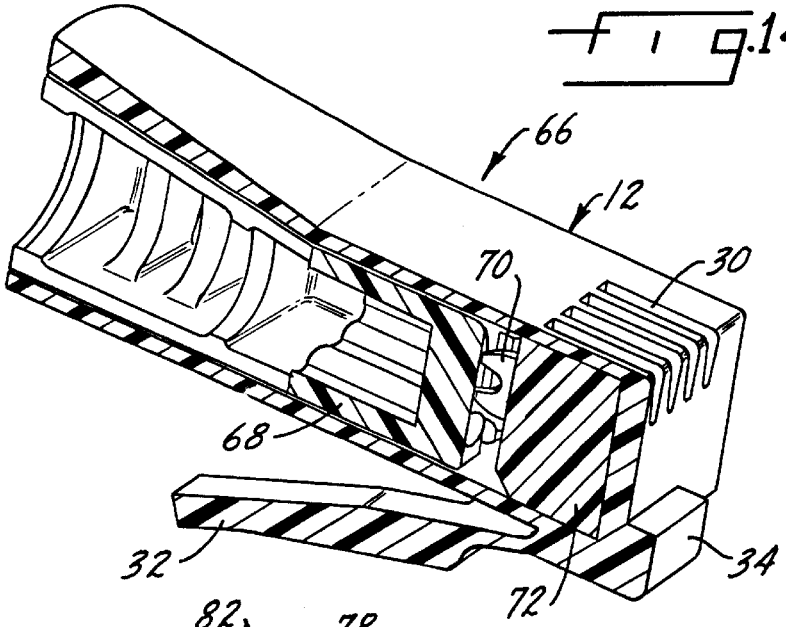
FIG. 14 is a perspective view, with a portion broken away, of an assembled connector plug according to an alternate form of the present invention. For clarity no cable is shown in the plug.

FIG. 14 illustrates an alternate embodiment of the connector plug 66. This version uses the same outer shell 12 but has a different wire mounting block 68. Also, the pc board is replaced by a set of contact plates 70 and a holder block 72.

Figure 15:
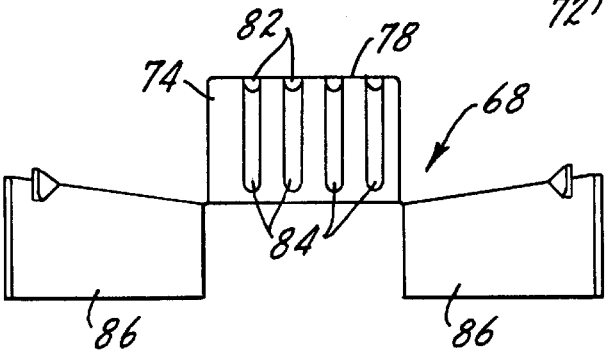
FIG. 15 is a top plan view of the alternate wire mounting block.
Figure 16:
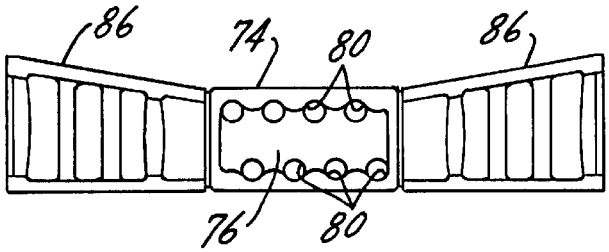
FIG. 16 is a rear end elevation view looking into the interior of the alternate wire mounting block.
Figure 17:
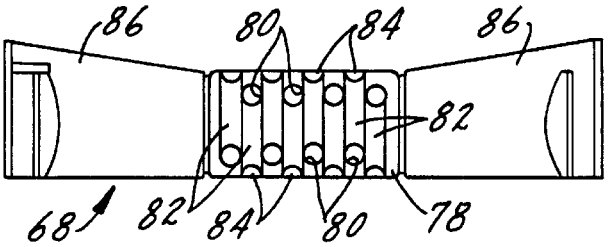
FIG. 17 is a front end elevation view of the alternate wire mounting block.

FIGS. 15–17 illustrate the alternate wire mounting block 68. It is similar to block 14 in that it has a five-sided body 74 with a hollow bore 76 and a front end face 78. The front end face 78 is different in that instead of four holes for wire pairs, it has eight holes 80 for individual wires. Thus, the cable is untwisted in the bore 76 and single wires are fed through holes 80. The wires are placed in grooves 82 on the exterior of the front face and troughs 84 on the top and bottom of the body 74. Sleeves 86 are attached to the body and have a similar structure and purpose as sleeves 40.

Figure 18:
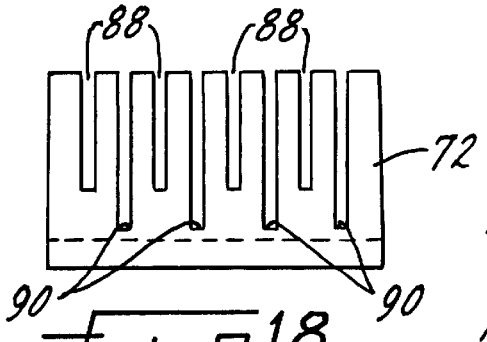
FIG. 18 is a front elevation view of the contact holder block.
Figure 19:
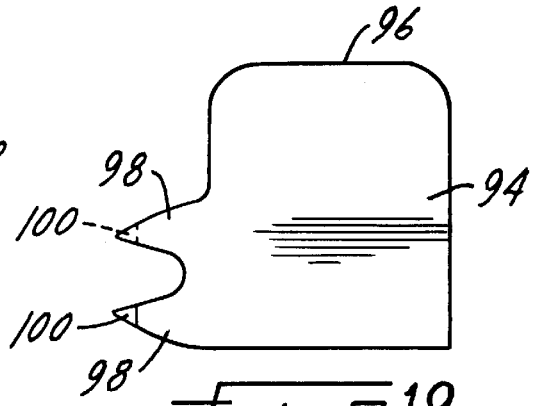
FIGS. 19 and 20 are side elevation views of the long and short contact plates, respectively.
Figure 20:
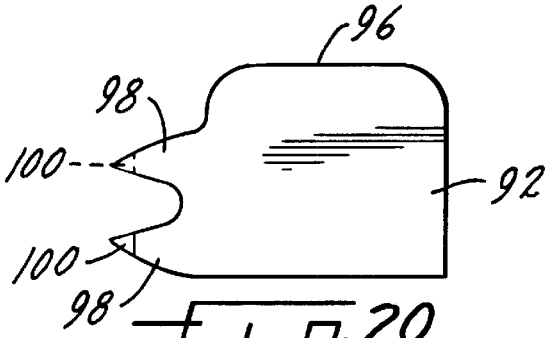
Figure 21:
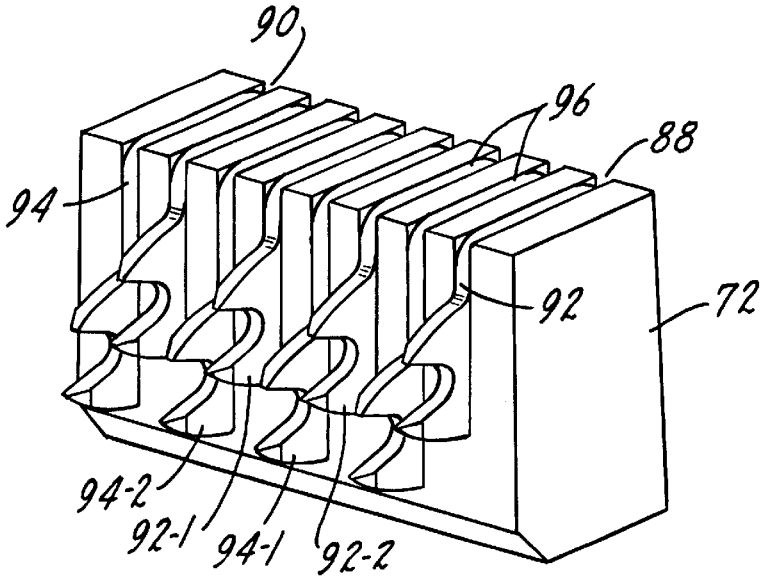
FIG. 21 is a perspective view of the contact holder block assembly.

The contact plate holder block 72 is shown in FIG. 18. It has two sets of four slots which open to the top surface of the block. Shallow slots 88 are interleaved with deep slots 90. The shallow slots receive a short contact plate 92 (FIG. 20) while the deep slots receive a long contact plate 94 (FIG. 19). The plates are press fit into the slots. The contact plates 92 and 94 are identical except for their heights. Each has a contact surface 96 on its top edge and a pair of barbs 98 extending from a side edge. The barbs have a coined or chiseled edge as at 100 that assists in penetrating the insulation layer of a wire. As can be seen in FIG. 21, the plates 92, 94, slots 88, 90 and holder block 72 are sized such that the contact surfaces 96 are substantially flush with the top of the block and the barbs protrude from the rear face of the block.

FIG. 21 also illustrates that the barbs are arranged in two rows. The center plates 92-1 and 94-1 correspond to pins 4 and 5 while plates 92-2 and 94-2 correspond to pins 3 and 6 in T568A and T568B. These are the pairs most likely to become involved in cross talk. By arranging these barbs as shown, the current loops in the 3–6, 4–5 pairs cross at right angles which reduces cross talk coupling.

The connector plug of FIG. 14 is prepared similarly to that of the FIG. 1 embodiment. When the wire mounting block 68 is pushed into the outer shell, the barbs 98 will pierce the insulation of the wires lying in the grooves 82. Since both the wires and the barbs lie in a vertical plane, the barbs may engage both sides of the conductor or both barbs may slip to the same side of the conductor. But since the grooves trap the wires in place, solid electrical contact is still assured regardless of the relative positions of the barbs and conductors.

It can be seen that in the FIG. 1 embodiment the printed circuit board 16 with its edge contacts 18, attachment elements 20 and connecting traces 64 serves the purpose of transposing the bundled cross-section of the UTP cable to a linear configuration with minimal untwisting of the wires. Similarly in the FIG. 14 embodiment, the contact holder block 72 and plates 92, 94 perform the same transposing function. Furthermore, the plug allows making connections to the wires without stripping them and with a simple pushing motion of the wire mounting block. This construction allows cost-effective, reliable connections with maximum data transmission speed.

While a preferred form of the invention has been shown and described, it will be realized that alterations and modifications may be made thereto without departing from the scope of the following claims. For example, attachment elements other than insulation displacement connectors could be used. The individual wires could be stripped and pressed into push-in connectors mounted on the circuit board.

What is claimed is:

1. An RJ-45 style modular connector for connecting a twisted pair cable having multiple, individual wires to an RJ-45 type jack having a linear array of spring contacts, comprising:

a shell defining a hollow interior and having a closed end sized to fit into the RJ-45 jack, the closed end including a plurality of slots extending through the shell and arranged to be aligned with the spring contacts of the RJ-45 jack, the shell farther defining an open end opposite the closed end;

transposition means disposed in the shell near the closed end for connecting the individual wires while in a bundled non-linear cross-section to a linear array of contact surfaces for mating with the spring contacts of the RJ-45 jack, the transposition means comprising a plurality of contact plates and a contact holder block, each contact plate having a conductive attachment element and one of the linear array of contact surfaces, said attachment elements being arranged in a non-linear pattern for connecting each attachment element to one of the individual wires of the twisted pair cable and being in electrical connection with the contact surfaces, said attachment elements being a pair of barbs extending from each of the contact plates, the contact surfaces being disposed in a linear array so as to be aligned with said shell slots and engageable with the spring contacts of an RJ-45 jack; and the contact holder block having slots for receiving the contact plates in a press fit, the attachment elements protruding from the contact holder block adjacent the wire mounting block and the contact surfaces being positioned on a top of the contact holder block adjacent the shell slots for mating with the spring contacts of the RJ-45 jack; and a wire mounting block insertable through the open end of the shell into the interior of the shell, the wire mounting block being engageable with the twisted pair cable and having means for supporting the individual wires thereof in alignment with the transposition means such that when the wire mounting block is inserted into the shell the transposition means will electrically connect to the individual wires;

wherein the contact plates have two different heights arranged in alternating engagement within the contact holder block slots, the barbs being located on a side edge of each contact plate, and the contact holder block having alternating deep and shallow slots for receiving the contact plates of different heights in order to provide a non-linear pattern of barbs for connecting with the individual wires while in the bundled non-linear cross-section.

2. The connector of claim 1 wherein the contact plates which fit into the contact holder block deep slots are located at right angles to the contact plates which fit into the contact holder block shallow slots to minimize cross talk.

* * * * *